US005103892A

United States Patent [19]

Hugens, Jr.

[11] Patent Number: 5,103,892

[45] Date of Patent: Apr. 14, 1992

[54] CONTINUOUS CASTING OF DISCRETE SHAPES

[75] Inventor: John R. Hugens, Jr., Salt Lake City, Utah

[73] Assignee: ASARCO Incorporated, New York, N.Y.

[21] Appl. No.: 731,390

[22] Filed: Jul. 17, 1991

Related U.S. Application Data

[63] Continuation of Ser. No. 486,452, Feb. 28, 1990, abandoned.

[51] Int. Cl.[5] ..... B22D 11/06

[52] U.S. Cl. ..... 164/431; 164/481

[58] Field of Search ..... 164/459, 460, 474–482, 164/418, 263, 427, 428–434

[56] References Cited

U.S. PATENT DOCUMENTS 4,276,921 7/1981 Lemmens et al. ..... 164/431

FOREIGN PATENT DOCUMENTS 2531357 1/1977 Fed. Rep. of Germany ..... 164/427
262331 5/1970 U.S.S.R. ..... 164/460
341582 7/1972 U.S.S.R. ..... 164/263

*Primary Examiner*—Kuang Y. Lin
*Attorney, Agent, or Firm*—John J. Tomaszewski; Kenneth A. Koch

[57] ABSTRACT

Continuous casting of discrete solid shapes from a molten material using modified continuous casting machines and processes are disclosed. In a conventional twin belt continuous caster, for example, forming means such as dividers are employed on the upper belt to define a mold cavity in the casting region of the machine. Different size and shape forming means may be used to provide a variety of cast products.

5 Claims, 3 Drawing Sheets

CONTINUOUS CASTING OF DISCRETE SHAPES

This is a continuation of copending application Ser. No. 07/486,452 filed on Feb. 28, 1990, now abandoned.

BACKGROUND OF THE INVENTION

The present invention relates to machines and processes for the casting of discrete solid shapes from a flowable, moldable or molten material. Specifically, the invention discloses continuously casting discrete shapes using a static mold casting machine or, preferably, a moving mold casting machine where, for example, the shapes are formed between spaced portions of a pair of endless flexible casting belts which are moved along with opposite surfaces of the metal being cast.

Although the principles of the invention can be used to cast any flowable, moldable or molten material such as plastics, the invention will be described in terms of continuously casting molten metal into discrete and variable shapes, such as ingots, anodes, wirebars or foundry castings.

Discrete metallic shapes are typically cast in individual molds using a discontinuous stream of molten metal. A plurality of mold cavities are supplied sequentially and the flow of metal in the desired quantity to each of the molds is controlled manually by an operator or in an automated manner. Continuous casting is employed, in a variety of forms, in the nonferrous and ferrous metals industry and elsewhere, to decrease production cost and increase product quality. Two basic systems known as the static and moving mold methods are used in continuous casting of shapes such as billets or continuous strips. In the static mold casting machine, the walls of the mold are stationary, while the cast products move against and solidify within them. Moving mold casting machines employ a belt, chain, drum, wheel, or other surface which moves at approximately the same speed as the solidifying metal.

The continuous casting of metal on moving mold casting machines having at least one movable belt and a corresponding fixed or movable surface which together form a mold of two opposed surfaces in which the cast material solidifies is described in detail in the following U.S. Pat. Nos. which are incorporated herein by reference: 2,631,343; 2,904,860; 3,036,348; 3,123,873; 3,123,874; 3,167,830; 3,533,463; 3,864,973; 3,878,883; 3,921,697; 3,937,270; 3,937,274; 3,949,805; 3,955,615; 4,002,197; and 4,854,371.

For a twin belt caster where two movable belts form the mold, in operation, a continuous stream of molten metal is supplied at the inlet of the machine to a cavity formed by a pair of movable flexible casting belts, positioned generally above the other, and side dam blocks, and emerges at the other end of the cavity (outlet of the machine) as a solidified strip or bar of metal. The strip or bar is subsequently fed to other apparatus for mechanical working, or cutting and/or welding, which changes its cross sectional dimensions. For example, twin belt casters of the type described are used to convert molten copper to a roughly rectangular bar shape which is then continuously fed to a rolling mill having a series of rolling stages for converting the rectangular bar to a round rod. Typically, the rod eventually is drawn to wire of various gauges.

In a previous attempt in the art to produce shaped articles continuously, a twin belt caster was modified by making the dam blocks smaller at certain intervals to provide a cast material having the shape of an anode, i.e., a flat rectangular shape having support arms. After casting, however, the casting had to be cut to form discrete anode shapes.

Another continuous casting moving mold method employs a casting wheel having a peripheral groove therearound. A portion of the peripheral groove is closed by an endless belt to form a mold into which molten metal is poured to be solidified into cast metal and discharged therefrom. Such designs may be seen in U.S. Pat. Nos. 3,279,000 and 3,469,620, which patents are hereby incorporated by reference.

Continuous casting using a static mold may be found in U.S. Pat. Nos. 2,938,251; 2,946,100; 3,066,364; 3,089,209; 3,098,269; and 3,115,686, which patents are hereby incorporated by reference. Basically, molten metal is continuously fed into the mold, freezes and the frozen product continuously removed from the mold. Generally, the mold is in a vertical position with the molten metal poured into the top of the mold.

While the casting machines described hereinabove are very successful and employed extensively throughout industry, the need still exists for these type continuous casting machines to produce discrete shapes. It is an object of the invention to provide apparatus and methods for the continuous casting of such discrete shapes.

SUMMARY OF THE INVENTION

The present invention is directed to an improvement in continuous casting machines and comprises apparatus and method for using a continuous casting machine to cast discrete shapes such as wire bars, ingots, billets, cakes, strips and foundry shapes from a stream of molten material. Although the invention can be employed in connection with various types of continuous casting machines, the invention for convenience will be described in detail for casting lead pigs using a twin belt caster wherein a pair of moving belts form a moving mold for molten metal.

The apparatus and method of the invention can be employed with any flowable, moldable or molten material such as plastics, ferrous or nonferrous metals including but not limited to steel, iron, copper, lead, bismuth and aluminum. The invention is particularly useful for the continuous casting of brittle or frangible materials which cannot normally be rolled, roll-formed, drawn or drilled in the solid state.

The method of the invention comprises the steps of supplying a continuous stream of molten material to a mold, static or moving, forming the continuous stream of molten material into discrete segments of predetermined volume and shape, solidifying said molten material and separating said segments into discrete shapes, said forming step taking place prior to any significant solidification of the molten metal. The forming step may be accomplished by using forming means such as inserts, dividers, spacers, and the like as will be described further hereinbelow.

The apparatus of the invention comprises a continuous casting machine having first means for defining a mold, said first means including a moving or static surface depending on the mold employed, second means for supplying a continuous stream of molten material to the mold, one or more forming members which form discrete chambers in the mold and form the molten material in the mold into a cast material in the form of discrete segments, solidifying means and separating means to separate the discrete segments into discrete shapes from the cast material. For a twin-belt caster the moving surface is planar whereas for a wheel caster the moving surface is curved. In a static mold, the mold is substantially stationary relative to the molten material and solidifed material moving through the mold. Static molds frequently employ reciprocating or other vibrating motions while casting

DETAILED DESCRIPTION OF THE INVENTION

Figure 1:
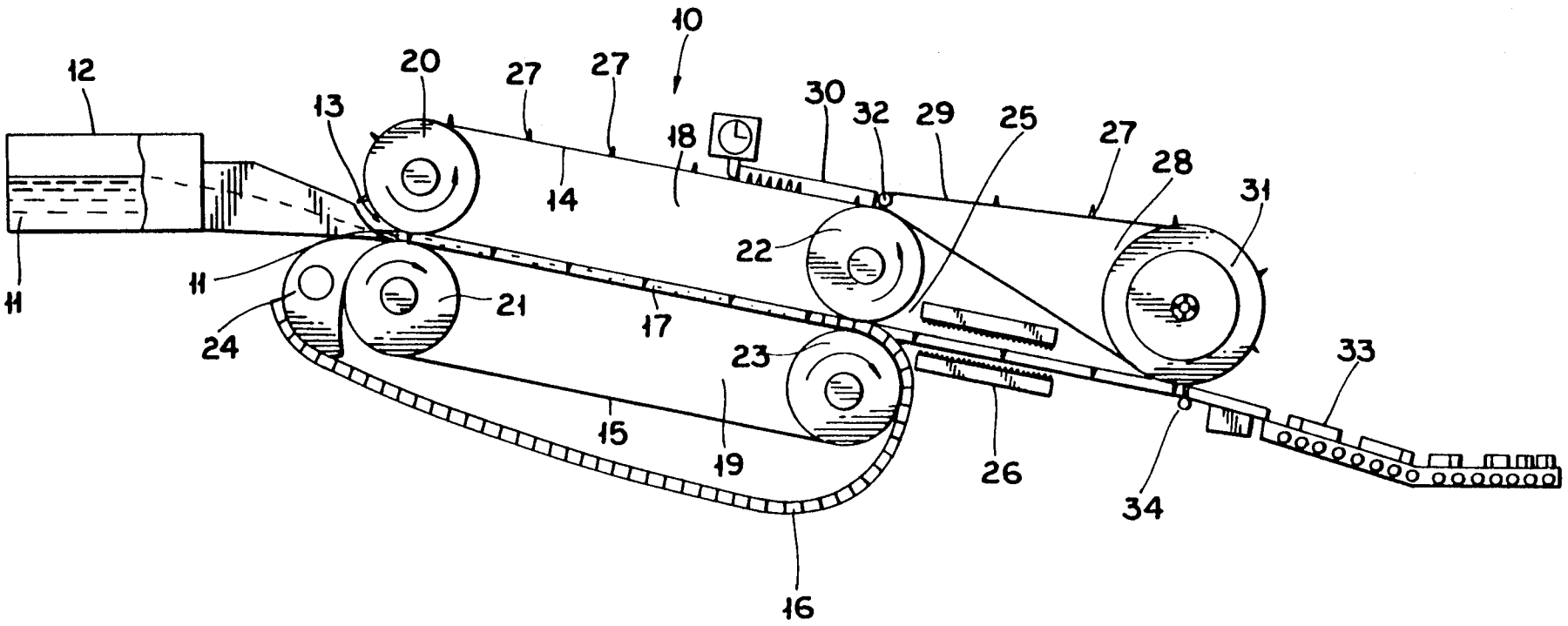
FIG. 1 is a schematic illustration of a twin-belt casting machine showing the improved forming means for forming discrete shapes.

An illustrative example of a continuous metal casting machine equipped with an embodiment of the present invention is shown in FIG. 1. In this casting machine 10 molten metal 11 is supplied from a pouring box or ladle (not shown) into a tundish 12. From the tundish 12, the molten metal 11 is fed into an input region 13 formed between spaced parallel surfaces of upper and lower endless flexible casting belts 14 and 15, respectively. The cavity formed between the belts 14 and 15 and dam blocks 16 may be defined as the casting region 17 wherein the molten metal is cast into a desired shape and solidified. The casting belts are preferably fabricated from steel, or other alloys, which provide toughness and resistance to abrasion and physical damage as well as resistance to the temperature shocks and heat differential stresses undergone during casting.

The casting belts 14 and 15 are supported on and driven by an upper and lower carriage generally indicated at 18 and 19, respectively. Both carriages are mounted on a machine frame (not shown). Each carriage includes two main rolls which support, drive and steer the casting belts. These rolls include upper and lower input rolls, 20 and 21, and upper and lower output rolls, 22 and 23, respectively.

A flexible, endless side metal retaining dam 16 is disposed on each side of the casting belts to define the side edges of the casting region for confining the molten metal. The side dams 16 are guided at the input end of the casting apparatus 10 by crescent shaped members 24 which are mounted on the lower carriage 19.

During the casting operation, the two casting belts 14 and 15 are driven at about the same linear speed by a driving mechanism and the upper and lower carriages are preferably downwardly inclined in the downstream direction, so that the casting region 17 between the casting belts is inclined. This downward inclination facilitates flow of molten metal into the casting region.

After the castings have solidified and leave the apparatus as indicated at 25, secondary cooler means 26 may be employed to completely solidify and/or cool the casting. The use of this technique is called "secondary cooling" and is used to generate higher casting speeds. The use of secondary cooling also facilitates removal of the forming means 27 from the cast metal by a thermal shock mechanism caused by different coefficients of expansion between the forming means and the cast metal. Greater differences between the coefficients will have a greater thermal shock and separation effect. The primary cooling means (not shown) is generally accomplished by the use of a high velocity moving liquid coolant travelling along the opposite sides of the belts 14 and 15 which form the mold.

The improved apparatus and method of the invention utilizes forming means 27 on the casting belts to provide a discrete shape in the mold and casting region 17 of the apparatus. The forming means 27 are preferably attached to the upper casting belt 14 and may vary in shape and spacing to define the desired mold shape in the casting region 17 of the apparatus. Exemplary forming means designs are described hereinbelow.

In a preferred embodiment of the invention, an additional carriage 28 and belt 29 are utilized to allow the forming means 27 to be separated from belt 14, collected in timing device 30 and positioned on belt 14 based on a predetermined desired spacing. By the use of this separator system, the weight (and size) of the discrete shapes cast during the casting operation may be varied by adjusting the timing device 30. Carriage 28 may employ two rolls 31 and 32 as indicated.

The discrete shapes 33 are fed out of the casting apparatus and transported to a desired location.

The caster 10 and the tundish 12 are preferably of the "open pool" type with the tundish outlet specially modified to permit the forming means 27 to enter the casting area 17. The pool of molten metal at the caster inlet 13 preferably fills the inlet so that the forming means 27 contacts the molten metal 11 at the inlet 13.

Figure 2:
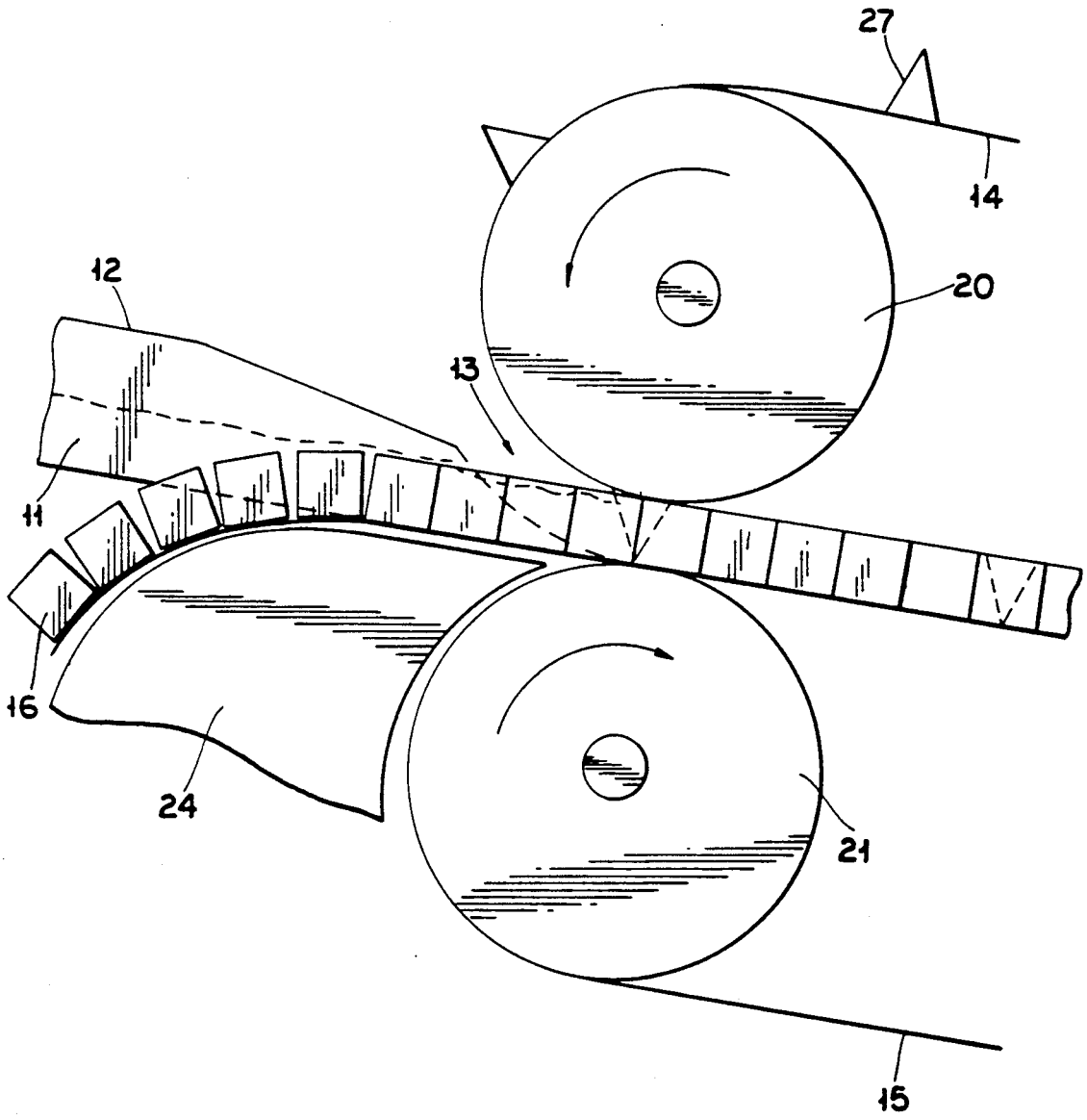
FIG. 2 is a side sectional view taken along a plane perpendicular to the input rolls and including the tundish, dam wall and molten metal.

The tundish tip is preferably made of graphite or other soft, ablating material which will also help the casting and lubrication of the lower belt 15. A drawing of the proposed arrangement is shown in FIG. 2. Since the metal, the belt, and the forming means all meet at approximately the same point, any gas or vapor behind the forming means 27 can escape into the open atmosphere and not cause a bubble to form behind the forming means in the metal casting. The dam blocks 16 preferably have a very slight taper on the internal surface (larger at the bottom) to prevent the forming means from turning or otherwise moving inside the mold.

As the metal passes through the caster, operation will be identical to a standard caster. However, the casting rate will generally be accelerated or inhibited by the use of the forming means 27 which act as heat sinks or insulators depending on the material used for the forming means.

In a preferred embodiment, the forming means 27 are removably attached, e.g., magnetically, to belts 14 and 29. In operation, the forming means will be spaced on belt 14 and, as the belt revolves, the desired casting shape will be formed. After solidification, the discrete casting will be separated from the continuous cast strip (containing the forming means 27) with the forming means becoming magnetically attached and transferred to belt 29. The forming means 27 will then be transferred to the timing device 30 where they will be aligned and released again to belt 14 at the desired spacing.

A device for separating the discrete castings from the strip of castings made in the caster may be conveniently employed at point 34. For example, a bending movement may be applied to the casting with the forming means 27 taken off on belt 29 and transferred to the casting belt 14 as described hereinabove.

Figure 3:
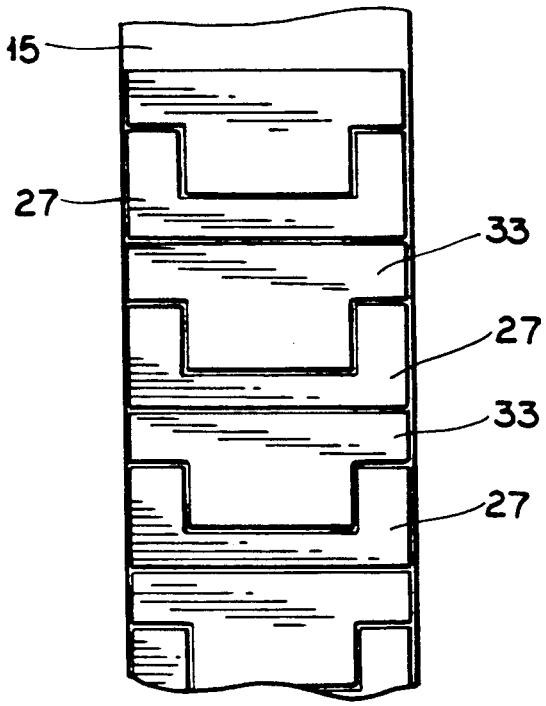
FIG. 3 is a top view of the lower casting belt showing an ingot shape formed using a particular forming means.
Figure 4:
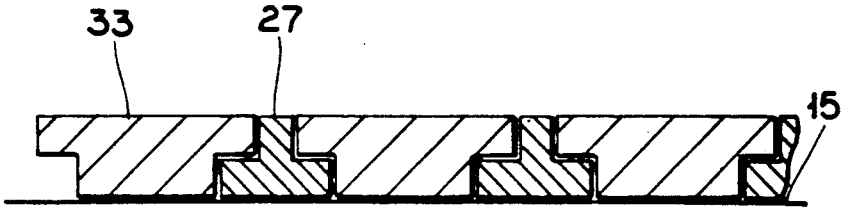
FIG. 4 is a side view of the lower casting belt showing an ingot shape formed using a particular forming means.

The designs for the forming means 27 can be quite variable. As shown in FIG. 3, a U-shape forming means 27 produces an ingot shape 33. Likewise, FIG. 4 shows an inverted T-shape forming means 27 which also produces an ingot shape 33. If required, holes, voids, indentations, brand names or other marks can be put into the casting with suitable forming means.

The forming means 27 may be made from a variety of materials. For magnetic dividers, the stronger the magnetic force of the forming means, the less internal taper or alignment will be needed to lock the forming means in the mold space. In some applications, it may even be desirable to make the forming means partly or wholly out of foundry sand, or refractory or metal beads as a substitute for drilling or casting complex holes and shapes in a casting or as a divider.

Removal of the forming means 27 from the belt 14 and/or, the casting may be facilitated by using forming means which are consumable (such as wood) or disposable. Another design is to employ a thin, flexible walled forming means containing a substance such as water which expands when contacted with the molten metal (because of the generation of vapor or steam in the forming means) and which contracts upon cooling. Thus, as the forming means contact the molten metal 11 the forming means expands and the casting is formed with the expanded forming means. After solidification and cooling, the forming means contracts facilitating its removal. A thin gauge stainless steel forming means may suitably be employed to cast lead pigs.

In an apparatus employing a casting wheel, forming means 27 may be placed on the wheel or belt to define the discrete shape desired in the mold being formed by the peripheral groove in the casting wheel and the endless belt as discussed hereinabove. For continuous casting using a static mold, the forming means 27 may be inserted into the mold cavity at desired intervals to provide a separation between the molten metal (a division into discrete shapes). Refractory beads may suitably be employed whereby the beads are fed into the mold cavity forming a separation between the molten metal being cast. The cast metal may then be easily separated into discrete shapes after solidification.

It will be apparent that many changes and modifications of the several features described herein may be made without departing from the spirit and scope of the invention. It is therefore apparent that the foregoing description is by way of illustration of the invention rather than limitation of the invention.

I claim:

1. A continuous casting apparatus comprising first means for defining a mold, said first means comprising two movable planar surfaces, second means for supplying a continuous stream of molten material to the mold, one or more forming means on one or both of the moving surfaces which means form discrete chambers in the mold and form the molten material in the mold into a cast material in the form of discrete segments, solidifying means and separating means to separate the discrete segments into discrete shapes from the cast materials.

2. The continuous casting apparatus of claim 1 wherein the forming means are positioned in the desired sequence on the upper movable planar surface.

3. The continuous casting apparatus of claim 2 wherein the two movable planar surfaces are belts.

4. The continuous casting apparatus of claim 3 wherein the forming means are removably attached to said movable planar surface.

5. The continuous casting apparatus of claim 4 further including means for removing said forming means from said planar surface, storing said forming means and repositioning said forming means on said movable planar surface.

* * * * *